United States Patent [19]

Yamagami

[11] Patent Number: 4,648,050

[45] Date of Patent: Mar. 3, 1987

[54] COLOR INDEX CONVERSION SYSTEM IN GRAPHIC DISPLAY DEVICE

[75] Inventor: Nobuhiko Yamagami, Tokyo, Japan

[73] Assignee: Kabushiki Kaisha Toshiba, Kawasaki, Japan

[21] Appl. No.: 629,973

[22] Filed: Jul. 11, 1984

[30] Foreign Application Priority Data

Jul. 15, 1983 [JP] Japan ..... 58-128918

[51] Int. Cl.[4] ..... G09G 1/00

[52] U.S. Cl. ..... 364/526; 340/703; 340/750

[58] Field of Search ..... 364/526; 340/703, 150

[56] References Cited

U.S. PATENT DOCUMENTS

| | | | |
|---|---|---|---|
| 4,180,805 | 12/1979 | Burson | 340/709 |
| 4,484,187 | 11/1984 | Brown et al. | 340/703 |
| 4,490,797 | 12/1984 | Staggs et al. | 340/703 |
| 4,536,848 | 8/1985 | d'Entremont et al. | 364/526 |

*Primary Examiner*—Parshotam S. Lall
*Assistant Examiner*—Danielle B. Laibowitz
*Attorney, Agent, or Firm*—Cushman, Darby & Cushman

[57] ABSTRACT

A color graphic display device for converting color index data read out from a plurality of frame memories to color information on a screen so as to perform graphic display has a first register for holding a group number determined in accordance with a combination of areas between copy source and destination memories of the plurality of frame memories for an interarea copy, and a ROM table for storing conversion color index data at a plurality of addresses of the group number and for receiving as address data linked data of an output from the first register and the color index data from the plurality of frame memories. The group number is set in the first register and the corresponding color index data is read out from the frame memories, thereby obtaining updated or converted color index data from the ROM table. The color graphic display device also has a second register for holding write enable/disable data for specifying the write enable/disable mode of the plurality of frame memories. The write enable/disable data is set in the second register so as to specify the copy destination frame memories, and the specific bits of the converted color index data are thereby selectively written only in the copy destination frame memories.

3 Claims, 4 Drawing Figures

COLOR INDEX CONVERSION SYSTEM IN GRAPHIC DISPLAY DEVICE

BACKGROUND OF THE INVENTION

The present invention relates to a color graphic display device for converting color index information to color information on a screen to perform graphic display and, more particularly, to a color index conversion system for interarea copy.

FIG. 1 shows a conventional graphic display device for performing graphic display by using frame memories 11 through 14. According to this device, for example, color index data B0 through B3 and position data (not shown) on the screen are specified to store pixel data in the frame memories 11 through 14. In this case, the frame editing and read/write operation are performed under the control of a frame editing block 15. Each bit of color index data CI corresponds to one pixel on a display monitor 16. The color index data divided and stored in these frame memories 11 through 14 are read out therefrom and are converted by a display conversion device 17 to a color information on the screen. Color display appears on the display monitor 16 in accordance with this color information. In addition, according to the conventional device, the frame memories 11 through 14 are divided into a plurality of groups (e.g., a group of frame memories 11 and 12, and a group of frame memories 13 and 14). In this case, the frame memories 11 and 12 serve as a display memory independently of a display memory constituted by the frame memories 13 and 14. For this reason, the graphic display by the frame memories 11 and 12 can be superposed on the graphic display by the frame memories 13 and 14 on the display monitor 16.

This conventional device can perform interarea copy processing for copying the contents of areas A of the frame memories 11 and 12 to areas B of the frame memories 13 and 14. This interarea copy operation is controlled by the frame editing block 15 in the following manner. Color index data (RCI) B3B2B1B0 corresponding to the areas A are sequentially read out from the frame memories 11 through 14. The bit data B3B2 of the copy source frame memories 11 and 12 (the frame memories subjected to a real read operation) of the readout color index data B3B2B1B0 are selectively extracted. This extraction operation is performed by the frame editing block 15. Subsequently, the bit data B3B2 are set in bit positions of bit data B1B0 of the copy destination frame memories 13 and 14 (i.e., the frame memories subjected to a real write operation). Next, the color index data xxB3B2, are updated (x represents that the corresponding bit can be logic "1" or "0"). This data updating is also performed by the frame editing block 15. Finally, the updated color index data (xxB3B2) is supplied to the frame memories 11 through 14, and the bit data B3B2 corresponding only to the frame memories 13 and 14 is written therein by the frame editing block 15.

In this manner, according to the conventional color graphic display device, the bit data corresponding to the copy source frame memories is selected from the corresponding color index data when interarea copy is performed. The selected bit data is then set in the bit positions corresponding to the copy destination frame memories so as to update the color index data. These two operations are an obstacle against high-speed copy between the areas. In addition, the firmware of the frame editing block 15 is overloaded.

SUMMARY OF THE INVENTION

It is an object of the present invention to provide a color index conversion system for performing high-speed color index data conversion required for interarea copy in a color graphic display device.

In order to achieve the above object of the present invention, there is provided a color graphic display device for converting to color information on a screen color index data which are read out from a plurality of frame memories and for performing graphic display, comprising:

a first register for holding a group number determined in accordance with a combination of areas between a copy source memory of said plurality of frame memories and a copy destination memory of said plurality of frame memories for an interarea copy;

a second register for holding write enable/disable data which represents a write enable/disable state of said plurality of frame memories;

a read only memory table for storing conversion color index data at a plurality of addresses of the group number and for receiving as address data linked data of an output from said first register and the color index data from said plurality of frame memories; and means for supplying a read output from said ROM table as converted color index data to said plurality of frame memories.

BRIEF DESCRIPTION OF THE DRAWINGS

Other objects and features of the present invention will be apparent from the following description taken in connection with the accompanying drawings, in which.

DETAILED DESCRIPTION OF THE PREFERRED EMBODIMENT

Figure 1:
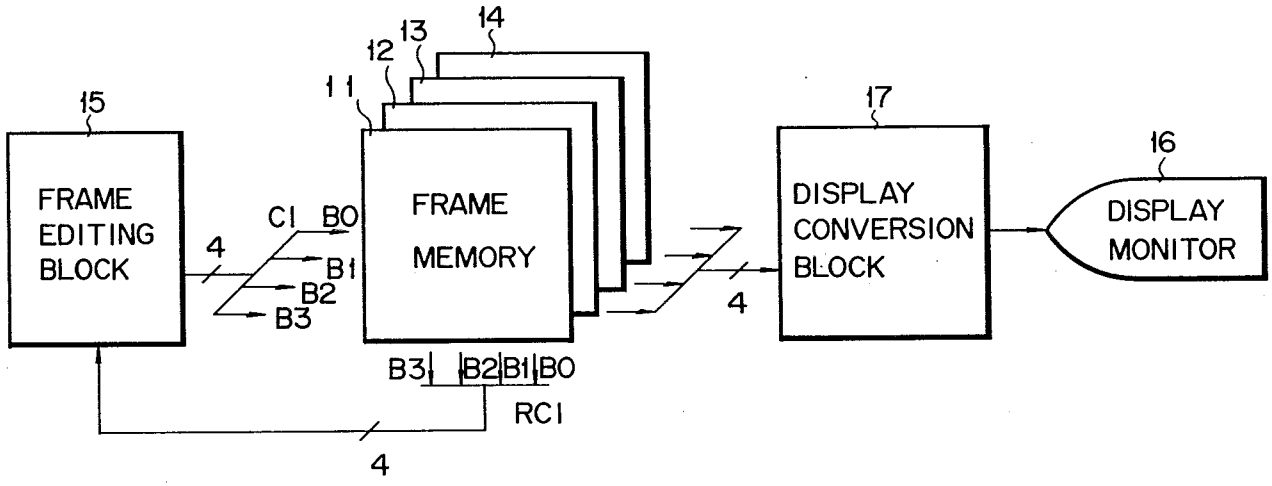
FIG. 1 (PRIOR ART)
FIG. 1 is a block diagram showing the overall configuration of a conventional color graphic display device.
Figure 2:
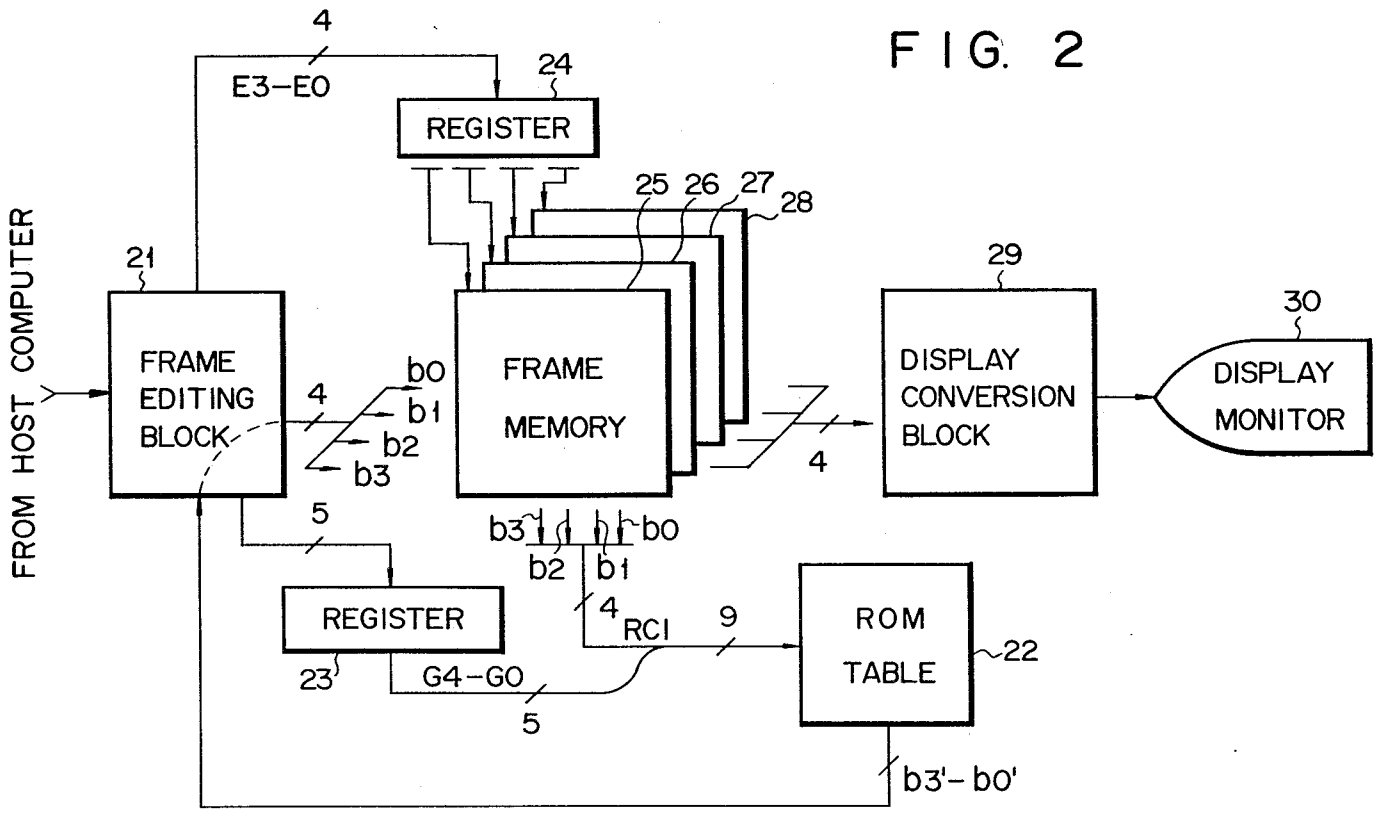
FIG. 2 is a block diagram showing the overall configuration of a color graphic display device according to an embodiment of the present invention.

FIG. 2 shows the overall configuration of a color graphic display device according to an embodiment of the present invention. A frame editing block 21 specifies 4-bit color index data CI and position data (not shown) of a display monitor 30 so as to control the graphic display. In this case, the frame editing block 21 reads out the color index data from frame memories 25 through 28 so as to perform interarea copy. When the interarea copy is performed, color index data b3b2b1b0 read out from a copy source area of the frame memories 25 through 28 is supplied as, for example, lower address bits to a ROM table 22 for color index conversion. The ROM table 22 receives as upper address bits the 5-bit output data from a first register 23. When interarea copy is performed, group number data of bits G4 through G0 is supplied from the frame editing block 21 to the register 23. The group number data of bits G4 through G0 are predetermined in accordance with combinations of the copy source frame memory and the copy destination frame memory.

The combinations are prepared such that, for example, the frame memories 25 and 26 are defined as copy source memories and the frame memories 27 and 28 are defined as copy destination memories, or the frame memories 25 and 27 are defined as the copy source memories and the memories 26 and 28 are defined as the copy destination memories, or the frame memory 25 is defined as the copy source memory and the frame memories 26 through 28 are defined as copy destination memories. In this embodiment, the contents of the source and destination frame memories are represented, as shown in Table I.

TABLE I

| Group No (Hex) | Input data from Host Computer | Copy source frame memory 25 | 26 | 27 | 28 | Copy destination frame memory 25 | 26 | 27 | 28 | |
|---|---|---|---|---|---|---|---|---|---|---|
| 01 | b3 – b0 (4 bit) | | | | | | | | * | |
| | | | | | | | | * | | |
| | | | | | | | * | | | |
| | | | | | | * | | | | |
| 02 | bi+1,bi (2 bit) | | | | | | | * | * | i=0,1,2 |
| | | | | | | * | * | | | |
| 03 | bi (1 bit) | | | | | | * | * | | i=0,1,2,3 |
| 04 | bi (1 bit) | | | | | | * | * | * | i=0,1,2,3 |
| 05 | bi (1 bit) | | | | | * | * | * | | i=0,1,2,3 |
| 06 | bi+1,bi (2 bit) | | | | | * | * | * | | i=0,1,2 |
| | | | | | | * | * | * | * | |
| | | | | | * | | | | * | |
| | | | | * | | | | * | | |
| | | | * | | | | * | | | |
| | | * | | | | * | | | | |
| | | | | * | * | | | * | * | |
| | | | * | * | | | * | * | | |
| | | * | * | | | * | * | | | |
| | | | * | * | * | | * | * | * | |
| | | * | * | * | | * | * | * | | |
| | | * | * | * | * | * | * | * | * | |
| 07 | | | * | * | * | | * | * | * | |
| | | | * | * | * | * | * | * | * | |
| 08 | bi+1,bi (2 bit) | | | | | | * | * | | i=0,1,2 |
| | | | | | | | * | * | * | |
| | | * | * | * | | * | * | * | * | |
| 09 | | | | * | * | | | * | * | |
| | | | | * | * | | * | * | * | |
| | | | | * | * | * | * | * | * | |
| 0A | | | * | * | | | * | * | * | |
| | | | * | * | | * | * | * | * | |
| 0B | | * | * | | | * | * | * | * | |
| 0C | | | | | * | | | | * | |
| | | | | | * | | | * | * | |
| | | | | | * | | * | * | * | |
| | | | | | * | * | * | * | * | |
| 0D | | | | * | | | | * | * | |
| | | | | * | | | * | * | * | |
| | | | | * | | * | * | * | * | |
| 0E | | | * | | | | * | * | * | |
| | | | * | | | * | * | * | * | |
| 0F | | * | | | | x | * | * | * | |
| | | * | | | | * | * | * | * | |
| 10 | | | | | * | | * | * | x | |
| | | | | | * | * | * | * | x | |
| 11 | | * | | | | x | * | * | | |
| 12 | | | | | * | | | * | x | |
| | | | | | * | | * | | x | |
| | | | | | * | * | | | x | |
| 13 | | | | * | | | | x | * | |
| | | | | * | | | * | x | | |
| | | | | * | | * | | x | | |
| | | | | * | * | | * | x | x | |
| | | | | * | * | * | | x | x | |
| 14 | | | * | | | | x | | * | |
| | | | * | | | | x | * | | |
| | | | * | | | * | x | | | |
| | | | * | * | | | x | x | * | |
| | | | * | * | | * | x | x | | |
| | | | * | * | * | * | x | x | x | |
| 15 | b3 – b0 (4 bit) | | | | | | | | * | |
| | | | | | | | | * | | |
| 16 | | | | | | | | | | |
| 17 | bi+1,bi (2 bit) | | | | | | | | | i=0,1,2 |
| | | | | | | | | | | |
| 18 | | | | | | | | | | |
| 19 | | | | | | | | | | |

TABLE I-continued

| Group No (Hex) | Input data from Host Computer | Copy source frame memory 25 | 26 | 27 | 28 | Copy destination frame memory 25 | 26 | 27 | 28 | |
|---|---|---|---|---|---|---|---|---|---|---|
| | | | | | | | * | | | |
| | | | | | | * | | | | |
| | | * | | | | x | | | * | |
| | | * | | | | x | | * | | |
| | | * | | | | x | * | | | |
| | | * | * | | | x | x | | * | |
| | | * | * | | | x | x | * | | |
| | | * | * | * | | x | x | x | * | |
| | | | | * | * | * | * | x | x | |
| | | | | | | | | * | * | i=0,1,2 |
| | | | | | | * | * | | | |
| | | * | * | | | x | x | * | * | |
| | | | * | | * | * | * | | x | |
| | | | | | | | x | * | * | |
| | | | | * | | | | x | | |
| | | | | | | * | * | x | | |
| | | * | | | | x | | * | * | |

In Table I, "*" indicates any copy source frame memory that has been designated and also any copy destination frame memory that has been designated. In this embodiment, the data input at the host computer may be copied, stored in the copy destination frame memories 25–28 and displayed. The ROM table 22 is a conversion table storing the color index data representing copying relations shown in Table I in the form of a pattern of "0" and "1" bits. This conversion table is so designed that the maximum value represented by the designated bit number of the copy source is stored at the copy destination when the primitive operation is performed to copy the data from the host computer and the number of designated bits of the copy source is greater than that of the copy destination. It is also so designed that the designated bits of the copy destination are taken from the designated bits of the copy source and are stored at the copy destination when the pixel operation is performed to copy the data from the frame memory and the number of designated bit number of the copy source is greater than that of the copy destination.

When the number of designated bit number of the copy source is less than that of the copy destination, the data defined by the designated bits of the copy source is stored at the lower bits of the copy destination and logic "0" is stored at the upper bits of the copy destination which define the difference between the number of designated bits of the copy source and that of the copy destination. In Table I, a plurality of copying relations are represented in a single group No. This means that the plurality of copying relations may be represented (controlled) with the same contents of the Table I.

Figure 3:
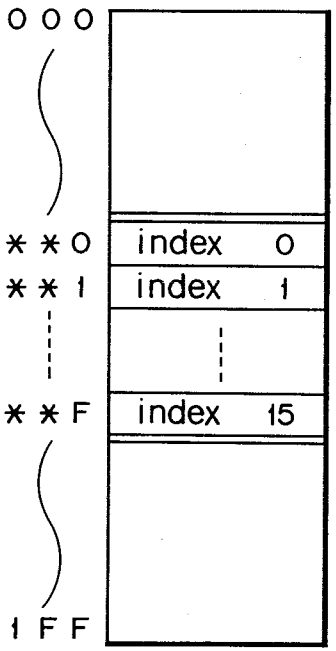
FIG. 3 is a memory map showing the contents of a ROM table 22 of FIG. 2.

The respective areas of the ROM table 22 which are designated by the upper five bits of the 9-bit address of the ROM table 22, or the group numbers G4 through G0 are used in combinations shown in Table I. These areas have 16 types of color index data, as shown in FIG. 3 stored therein. The relative address of each area comprises four remaining bits of a 9-bit address (i.e., the color index data b3 through b0 of the frame memories 25 through 28). In this embodiment, for example, when the frame memories 25 and 26 are copy source memories and the frame memories 27 and 28 are copy destination memories in accordance with the group number data of bits G4 through G0, the following 4-bit conversion color index data is stored in the 16 addresses of the areas within the ROM table 22 which are indicated by the bits G4 through G0 of the group number data. More specifically, when the 4-bit relative address representing the area of the ROM table 22 is given to be b3b2b1b0, the 4-bit color index data xxb3b2 (x is logic "1" or "0") is stored at the address b3b2b1b0. Similarly, when the frame memories 25 and 27 are copy source memories and the frame memories 26 and 28 are copy destination memories in accordance with the group number data of bits G4 through G0, the corresponding areas of the ROM table 22 which are specified by the group number data of bits G4 through G0 store color index data b3′ through b0′ (xb3xb1) at the address b3b2b1b0.

Figure 4:
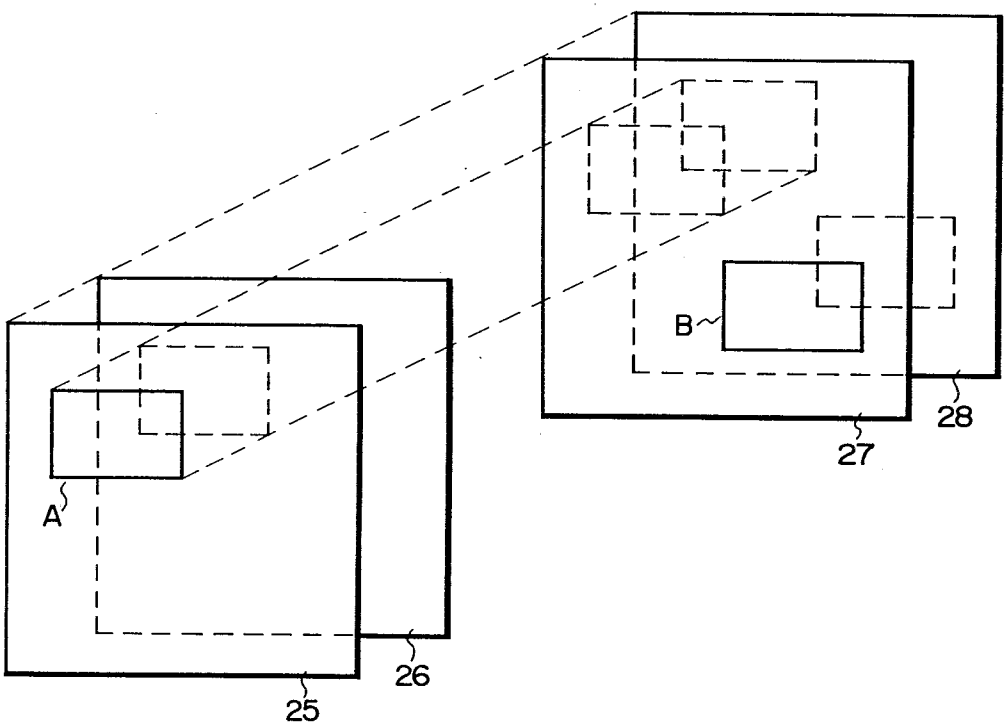
FIG. 4 is a graphic representation for explaining interarea copy.

As shown in FIG. 4, assume that the contents of the areas A of the frame memories 25 and 26 are copied in the areas B of the frame memories 27 and 28. In this case, the contents of the ROM table 22 are shown in Table II below.

TABLE II

| | Source data | | | | Destination data | | | | |
|---|---|---|---|---|---|---|---|---|---|
| Group No | b3 (25) | b2 (26) | b1 (27) | b0 (28) | b3′ (25) | b2′ (26) | b1′ (27) | b0′ (28) | HEX |
| 17 | 0 | 0 | 0 | 0 | 0 | 0 | 0 | 0 | 0 |
| | 0 | 0 | 0 | 1 | 0 | 0 | 0 | 0 | 0 |
| | 0 | 0 | 1 | 0 | 0 | 0 | 0 | 0 | 0 |
| | 0 | 0 | 1 | 1 | 0 | 0 | 0 | 0 | 0 |
| | 0 | 1 | 0 | 0 | 0 | 1 | 0 | 1 | 5 |
| | 0 | 1 | 0 | 1 | 0 | 1 | 0 | 1 | 5 |
| | 0 | 1 | 1 | 0 | 0 | 1 | 0 | 1 | 5 |
| | 0 | 1 | 1 | 1 | 0 | 1 | 0 | 1 | 5 |
| | 1 | 0 | 0 | 0 | 1 | 0 | 1 | 0 | A |
| | 1 | 0 | 0 | 1 | 1 | 0 | 1 | 0 | A |
| | 1 | 0 | 1 | 0 | 1 | 0 | 1 | 0 | A |
| | 1 | 0 | 1 | 1 | 1 | 0 | 1 | 0 | A |
| | 1 | 1 | 0 | 0 | 1 | 0 | 1 | 1 | F |
| | 1 | 1 | 0 | 1 | 1 | 0 | 1 | 1 | F |
| | 1 | 1 | 1 | 0 | 1 | 0 | 1 | 1 | F |
| | 1 | 1 | 1 | 1 | 1 | 0 | 1 | 1 | F |

In Table II, the number in the bracket represents a reference number of the frame memory. In this case, the frame editing block 21 sets 5-bit group number data ("10111"="17"$_H$ where H is the hexadecimal notation) in the register 23 and 4-bit write enable-disable data E3 of bits E3 through E0 in a second register 24. The second register 24 generates a write enable/disable prohibit pulse to the frame memories 25 to 28 in units of bits. In the case shown in FIG. 4 wherein the frame memories 27 and 28 are the copy destination frame memories, the frame editing block 21 sets the write enable/disable data of bits E3 through E0 as "0011" in the second register 24. Therefore, a signal of logic "0" is supplied to the frame memories 25 and 26, and a signal of logic "1" is supplied to the frame memories 27 and 28, so that the write mode is set. When the frame editing block 21 completes the data setting operation of the registers 23 and 24, the color index data b3b2b1b0 are sequentially read out from the areas A of the frame memories 25 and 26 and the corresponding areas from the frame memories 27 and 28 in units of pixels. The bits b3 through b0 of the color index data CI are linked with the 5 bits G4 through G0 of the group number data, and the resultant data is supplied as the ROM address to the ROM table 22. The conversion color index data having bits b3′ through b0′ whose content is given to be xxb3b2 is stored in the address of the ROM table 22 which is accessed in response to the data (G4 through G0 and b3 to b0). For example, when the color index data as the source data which is read out from the frame memories 25 to 28 and which has bits b3 to b0 is "0100", the conversion color index data (destination data) read out from the ROM table 22 has bits b3′ through b0′ of "0101". Similarly, when bits b3 through b0 are set to be "1110", conversion color index data has bits b3′ through b0′ of "1011". In other words, outputs b1′ and b0′ ("01" or "11") are produced so as to copy outputs b3 and b2 ("01" or "11") from the frame memories 25 and 26 into the frame memories 27 and 28. As a result, when the address data is supplied to the ROM table 22, the color index data having bits b3′ through b0′ whose content is converted to "xxb3′b2′" is read out. This color index data is supplied to the frame editing block 21. The frame editing block 21 supplies to the frame memories 25 through 28 the color index data which has the bits b3′ through b0′ and which is read out from the ROM table 22. In this case, the write operation is enabled in the frame memories 27 and 28 of the frame memories 25 through 28 in response to write enable bit data of the bits E3 through E0 of the write enable/disable data set in the register 24. Therefore, the bits b3′ and b2′ of the color index data having the bits b3′ through b0′ whose content is given to be xxb3′b2′ are written in the accessed frame memories 27 and 28. The 4-bit data from the frame memories 25 through 28 is supplied to the display monitor 30 through a display conversion block 29 and is displayed on the display monitor 30.

According to the present invention as described above, since data predetermined by combinations of the copy source frame memories and the copy destination frame memories is set in the predetermined register, the color index data from the image memory can be directly converted into the corresponding color index data. For this reason, the interarea copy required in the color graphic display device can be performed at high speed. In addition, special processing can be performed merely by updating the content of the ROM table. In the above embodiment, the contents of the ROM table 22 are limited to the most frequent 32 combinations. However, the number of combinations stored in the ROM table is not limited to this, but can be increased to all possible combinations.

What is claimed is:

1. In a color graphic display device having a plurality of frame memories, apparatus for copying color index data read out from at least one designated area of a first frame memory into at least one designated area of a second frame memory in oder to convert color information on screen color index data which are read out from said plurality of frame memories, comprising:

frame editing means adapted for controlling copy and edit operations among said frame memories, and for providing a group number determined in accordance with a combination of areas between a copy source memory of said first frame memory and a copy designation memory of said second frame memory, and for providing write enable/disable data which represents a write enable/disable state of said plurality of frame memories;

first register means, coupled to said frame editing means, for holding said group number output from said frame editing means;

second register means, coupled to said frame editing means, for holding said write enable/disable data output from said frame editing means;

read only memory means, coupled to said plurality of frame memories and to said first register means and to said frame editing means, for storing conversion color index data at a plurality of addresses, and for receiving, as address data, linked data comprising said group number output from said first register means and the color index data output from said plurality of frame memories; and writing means, coupled to said frame editing means, for receiving from said frame editing means data read out from said read only memory means, and for writing said data to said plurality of frame memories as converted color index data.

2. A device according to claim 1, wherein said frame editing means sets the group number in said first register means and the right enable/disable data in said second register means before an interarea copy is performed.

3. A device according to claim 1, wherein the group number from said first register means serves as upper address bits of said read only memory table and the color index data from said plurality of frame memories serves as lower address bits of said read only memory means.

* * * * *